US010895846B2

(12) United States Patent
Raffy

(10) Patent No.: US 10,895,846 B2
(45) Date of Patent: Jan. 19, 2021

(54) REVERSIBLE WRISTWATCH WITH MULTIPLE CONFIGURATIONS

(71) Applicant: Pascal Raffy, Mont-sur-Rolle (CH)

(72) Inventor: Pascal Raffy, Mont-sur-Rolle (CH)

( * ) Notice: Subject to any disclaimer, the term of this patent is extended or adjusted under 35 U.S.C. 154(b) by 253 days.

(21) Appl. No.: 16/076,738

(22) PCT Filed: Feb. 6, 2017

(86) PCT No.: PCT/EP2017/052565

§ 371 (c)(1),
(2) Date: Aug. 9, 2018

(87) PCT Pub. No.: WO2017/137359

PCT Pub. Date: Aug. 17, 2017

(65) Prior Publication Data

US 2019/0049901 A1 Feb. 14, 2019

(30) Foreign Application Priority Data

Feb. 12, 2016 (CH) ..... 189/16
Feb. 12, 2016 (EP) ..... 16155594

(51) Int. Cl.
*G04B 37/04* (2006.01)
*G04B 37/14* (2006.01)

(52) U.S. Cl.
CPC ..... *G04B 37/0427* (2013.01); *G04B 37/0454* (2013.01); *G04B 37/1426* (2013.01)

(58) Field of Classification Search
CPC ..... G04B 37/0427; G04B 37/0454; G04B 37/1426; G04B 37/1446; G04B 37/0008; G04B 37/0016; G04B 37/0025; G04B 37/0033; G04B 37/0041; G04B 37/005; G04B 37/16; G04B 37/18; G04B 37/20
USPC ..... 368/282, 276–277, 301–302, 281
See application file for complete search history.

(56) References Cited

U.S. PATENT DOCUMENTS 5,158,219 A 10/1992 Baumgartner
6,130,861 A 10/2000 Della Felice
6,712,501 B2 * 3/2004 Kinkio ..... A44C 5/14 224/169

(Continued)

FOREIGN PATENT DOCUMENTS

CH 179155 8/1935
CH 622662 4/1981

(Continued)

*Primary Examiner* — Edwin A. Leon
(74) *Attorney, Agent, or Firm* — . Duane Morris LLP; Gregory M. Lefkowitz; Jason M. Nolan

(57) ABSTRACT

A wristwatch is described, including a middle having a side wall, defining a median plane and further having attachment members for securing respective first and second ends of a strap to the middle, and a cover capable of pivoting, relative to the middle, between a first closed position in which the ends of the strap are locked onto the middle, and a second open position in which the ends of the strap are free to be separated from the middle. The cover is arranged so as pivot about a rotational axis parallel to the median plane, each attachment member including a hole provided in the side wall and intended for receiving the corresponding end of the strap by insertion in a direction substantially parallel to the median plane.

20 Claims, 7 Drawing Sheets

(56) References Cited

U.S. PATENT DOCUMENTS

| | | | | |
|---|---|---|---|---|
| 6,738,317 | B2 * | 5/2004 | Nussbaum | A44C 5/00 368/281 |
| 6,779,917 | B1 * | 8/2004 | Chappuis | G04B 37/0083 368/276 |
| 7,249,398 | B2 | 7/2007 | Roy | |
| 7,507,017 | B2 | 3/2009 | Chevalier et al. | |
| 8,007,165 | B1 * | 8/2011 | Lalo | G04B 37/1486 224/180 |
| 9,122,248 | B2 | 9/2015 | Raffy | |
| 9,474,344 | B2 * | 10/2016 | Goeller | G04B 37/0427 |
| 9,639,058 | B1 * | 5/2017 | Mohanty | A44C 5/14 |
| 2006/0018202 | A1 * | 1/2006 | Girardin | G04B 37/0436 368/281 |
| 2006/0126445 | A1 * | 6/2006 | Bouille | G04B 37/0083 368/281 |

FOREIGN PATENT DOCUMENTS

| | | |
|---|---|---|
| CH | 698787 | 10/2009 |
| CH | 704756 | 10/2012 |
| CH | 705240 | 1/2013 |
| DE | 202010013569 | 2/2011 |
| EP | 0714051 | 5/1996 |
| EP | 1047982 | 8/2005 |
| FR | 697795 | 1/1931 |
| FR | 935435 | 6/1948 |
| WO | 2010057940 | 5/2010 |

* cited by examiner

Fig. 13
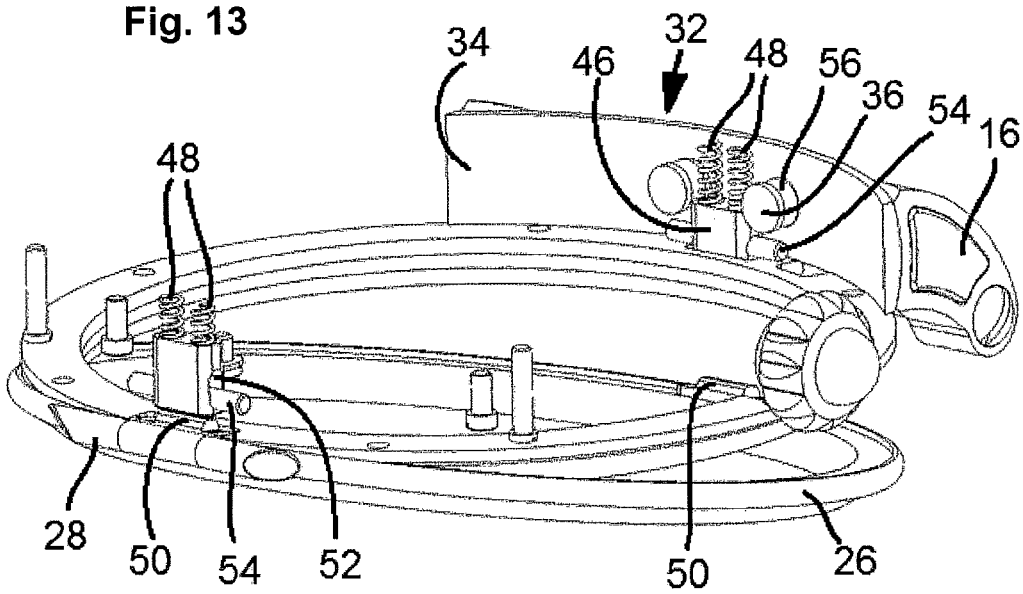
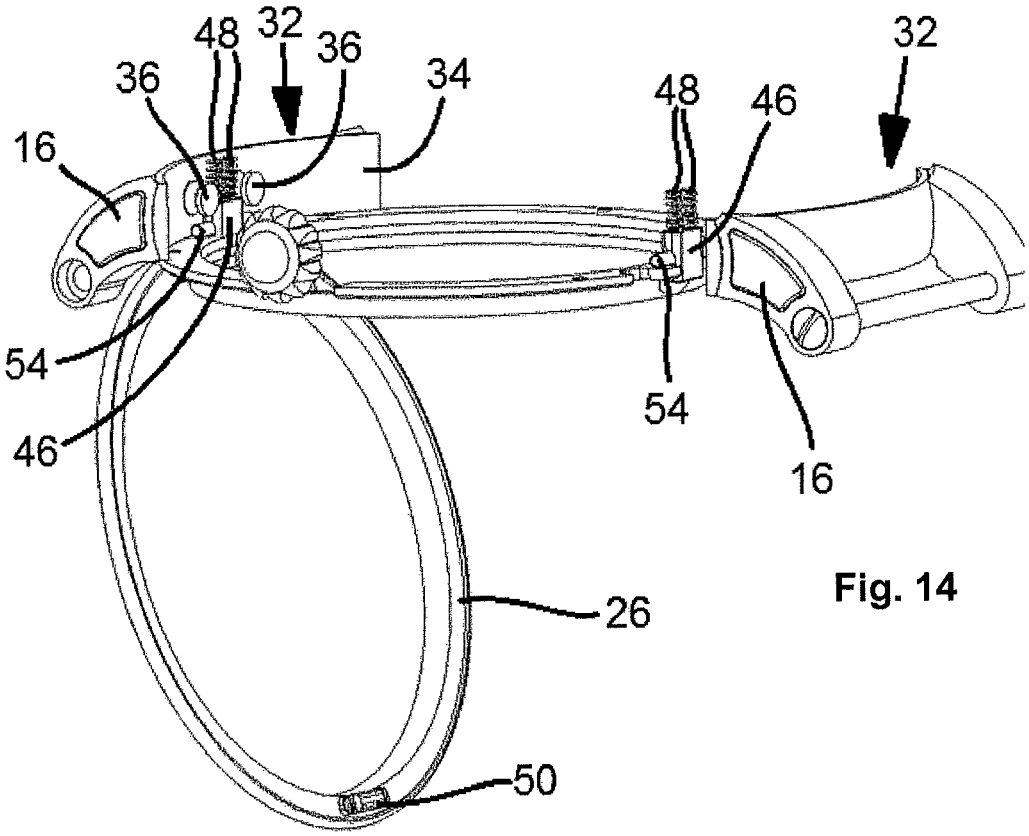
Fig. 14

REVERSIBLE WRISTWATCH WITH MULTIPLE CONFIGURATIONS

CROSS-REFERENCE TO RELATED APPLICATIONS

This application is a § 371 national stage entry of International Application No. PCT/EP2017/052565, filed Feb. 12, 2017, which claims priority to European Patent Application No. EP16155594.1, filed Feb. 12, 2016, and Swiss Patent Application No. 00189/16, filed Feb. 12, 2016, the entire contents of which are incorporated herein by reference.

TECHNICAL FIELD

The present invention relates to a wristwatch including:

a middle having a side wall, joining first and second faces of the middle defining a plane between them, and comprising first and second fastening organs of a bracelet that are diametrically opposite, to secure respective first and second ends of a bracelet to the middle, a cover arranged to be able to at least partially cover one of the first and second faces while being able to pivot in reference to the middle between a first, closed position, in which the ends of the bracelet are locked on the middle, and a second, open position, in which the ends of the bracelet are free to be separated from the middle.

More specifically, the present invention relates to such a type of wristwatch in which the bracelet can be removed from the case without requiring the use of tools.

Within the meaning of the invention, a cover should be understood as an element that can cover all or part of a face of the middle, i.e., it may in particular assume the form of a solid back, or even optionally provided with a window, or alternatively, a bezel that can be considered a back whose center is hollowed out. In the case of a bezel, it is possible to provide that it bears a glass or that it is open at its center without going beyond the scope of the present invention.

BACKGROUND OF THE INVENTION

Many timepieces satisfying the above features have already been disclosed in the prior art, in particular wristwatches whereof the case has identical bracelet fastening organs on each side.

Patent CH 698787 B1 provides one example of a wristwatch satisfying the features set out above, in which the middle has two pairs of horns to provide the fastening of the bracelet. A support is further arranged between each pair of horns, each of the supports bearing two fastening posts of the bracelet. Furthermore, this wristwatch comprises a rotary bezel bearing two lugs that can be positioned each across from one of the supports to lock the bracelet or offset relative to the supports to release the bracelet. Owing to these features, the bracelet can be changed easily and without it being necessary to use a tool.

However, this wristwatch has a drawback related to the fact that the change of bracelet must preferably be done on a stable surface, for example a table, to be able to deposit the bezel and place it without risk of dropping it while the old bracelet is removed and the new bracelet is placed by being engaged on the posts.

Furthermore, the present invention relates to a wristwatch of the aforementioned type in which the middle can show either of its two faces to the user in the usage position.

The wristwatch of the prior art that has just been described is not of the reversible type, i.e., its middle has a single usage face intended to be visible to the wearer when it is worn, the other face of the middle being intended to be positioned against the wearer's wrist.

The patent application published under no. WO 2010/057940 A1 describes an example of a wristwatch including a case comprising a bottom pivoted on a middle, the face of the bottom located across from the middle being provided with two grooves intended each to receive a fastening bar of a bracelet strand. More specifically, each groove is curved to follow the curvature of the case and the associated bar has a similar curvature. The assembly of the bracelet to the case must be done in the open configuration of the bottom in reference to the middle, to free the grooves. The bar of each bracelet strand can then be inserted in the corresponding groove, in a direction substantially perpendicular to a median plane of the bottom. The bar is inserted forcibly in the corresponding groove, by elastic deformation, the bottom next being brought back against the middle, in a closed configuration, to provide locking of the bars in the grooves. The manipulation of the bars seeking to insert them in the grooves of the bottom of the case, or to remove them therefrom, requires a certain dexterity and in particular risks damaging the user's fingernails. Furthermore, such a forcible insertion does not give a high-quality impression of the corresponding product and is for example not well suited to an application in the luxury segment. Furthermore, such a construction poses constraints in terms of thickness for the middle and for the bottom, given that these two elements must have a substantial rigidity to provide correct locking of the bracelet. Thus, for example, a thin bottom having a shape similar to that of a bezel may not be suitable for implementing the construction disclosed in this document. These constraints are reflected in a substantial minimum thickness for the corresponding watch case.

BRIEF DESCRIPTION OF THE INVENTION

One primary aim of the present invention is to propose a wristwatch with an alternative construction to the constructions known from the prior art, which not only may have its bracelet replaced easily, but which may also be worn while indifferently showing one or the other of the faces of its middle to the wearer without this being detrimental to its appearance and which further may be used differently than as a wristwatch also without this being detrimental to its appearance.

To that end, the present invention more particularly relates to a wristwatch of the aforementioned type, characterized in that the cover is arranged to be able to pivot along a rotation axis substantially parallel to the median plane of the middle, and in that each of the first and second fastening organs comprises a hole arranged in the side wall of the middle and intended to receive the corresponding end of the bracelet by insertion in a direction substantially parallel to the median plane.

Owing to these features, the bracelet of the wristwatch according to the present invention can be changed very easily, since a simple pivoting of the cover makes it possible to release it, which can be done holding the watch in one hand while manipulating it with the other hand. Furthermore, once the cover is positioned in its open position, it remains secured to the case and does not risk falling during the manipulation of the bracelet.

Furthermore, the nature and the implantation of the fastening organs of the bracelet arranged on the middle are such that the latter can be turned over to indifferently show one or the other of its faces to the wearer in the usage position. This advantage can be optimized by providing, in a preferred alternative embodiment, that the holes of the middle are arranged substantially in the median plane to allow an indifferent use of the first face or the second face in the usage position.

Lastly, the nature and the implantation of the fastening organs of the bracelet arranged on the middle also make it possible to use the wristwatch according to the present invention in configurations other than as a wristwatch, without this being detrimental to its appearance, i.e., as a table watch or pocket watch in connection with an appropriate chain.

Furthermore, the implantation of the fastening organs of the bracelet on the middle also allows the builder to have great latitude in defining the shape and dimensions of the cover, unlike the watch described in application WO 2010/057940 A1, for which the structure of the fastening organs does not make it possible to implant them directly on the middle, such that they are accessible by the side wall of the latter.

Advantageously, the wristwatch according to the present invention includes first and second inserts secured to the bracelet, to define the first and second ends thereof, and each of which bears a male fastening organ intended to be inserted in the corresponding hole of the middle to secure the first and second ends of the bracelet to the middle.

Owing to these features, the middle may have a purer shape and appearance, allowing particularly well to use of the watch in different configurations without this being detrimental to its appearance.

Furthermore, it is possible to provide that each of the first and second fastening organs of the middle comprises a locking piece movable between a locking position, associated with the closed position of the cover and in which it acts on the corresponding end of the bracelet to lock it, and a neutral position, associated with the open position of the cover and in which it frees the corresponding end of the bracelet, the cover having first and second actuating organs arranged to cooperate with the locking pieces and position them in their locking position in the closed position of the cover.

Owing to these features, the builder has greater flexibility to produce the mechanism providing locking of the bracelet and to isolate the cover from the locking mechanism in terms of the mechanical constraints that the bracelet may exert on the case of the watch.

Advantageously, each of the first and second fastening organs also comprises an elastic organ arranged to act on the corresponding locking piece and tending to position it in its neutral position.

According to one preferred embodiment, it is possible to provide that each of the locking pieces comprises a sliding block arranged

- to cooperate, on the one hand, with the corresponding actuating organ of the cover, and on the other hand, with the elastic organ, and
- to act on a moving pin arranged to lock the corresponding end of the bracelet in the closed position of the cover.

Owing to these additional features, the builder in particular has greater freedom to ensure optimal reliability of the locking mechanism of the bracelet while limiting its bulk.

In this case, it may be advantageous to provide that each of the male fastening organs has a recess arranged to cooperate with the corresponding pin in the closed position of the cover.

In general, it is possible to provide that each of the inserts of the bracelet comprises two horns to provide its mechanical connection to the bracelet.

Alternatively, it is possible to provide that at least one of the inserts comprises a bow to provide its mechanical connection to the bracelet.

In general, it is preferably possible to provide that the cover is mechanically connected to the middle via a hinge and that one of the actuating organs is adjacent to the hinge.

Owing to these features, it is possible to provide that a first end of the bracelet is freed first, after pivoting of the cover by a first limited angle, the second end of the bracelet only being released secondly, after pivoting of the cover by a second angle larger than the first. Thus, the manipulation of the wristwatch during the release of the bracelet is very simple, since the user is only required to manipulate a single end of the bracelet at a time.

According to one preferred embodiment of the present invention, each of the fastening organs of the middle comprises an additional hole arranged in the side wall of the middle, each of the male fastening organs comprising two studs intended to be inserted in the corresponding holes of the middle to provide the connection of the bracelet to the middle.

In this case, it may be advantageous to provide that each of the inserts comprises a plate bearing the studs, and that the side wall of the middle has two recesses arranged around the holes and each of which is suitable for at least partially housing one of the plates when the bracelet is assembled to the middle.

Furthermore, according to one preferred embodiment, it is possible to provide that the wristwatch includes a locking device of the cover arranged to lock it in at least one preferred open angular position, in reference to the middle, such that the cover can define a support for using the wristwatch as a table watch when the bracelet is freed from the middle.

In general, the wristwatch preferably comprises a locking organ arranged to guarantee the stability of the closed position of the cover against the middle.

The present invention also relates to an assembly including a wristwatch satisfying the above features and a chain bearing an insert comprising a male fastening organ able to be inserted into one of the holes of the middle to secure the chain to the middle and to allow the use of the wristwatch as a pocket watch when the bracelet is freed from the middle.

BRIEF DESCRIPTION OF THE DRAWINGS

Other features and advantages of the present invention will appear more clearly upon reading the detailed description of one preferred embodiment that follows, done in reference to the appended drawings, provided as non-limiting examples and in which:

FIG. 13 shows a simplified perspective view of the construction detail of FIG. 12, in a second configuration; and FIG. 14 shows a simplified perspective view of the construction detail of FIG. 12, in a third configuration.

DETAILED DESCRIPTION OF THE INVENTION

FIGS. 1 to 11 show different simplified general perspective views of a wristwatch 1 according to one preferred embodiment of the present invention, in different configurations. More specifically, the wristwatch 1 can be used as a wristwatch while being associated with a bracelet, as a pocket watch or even as a table watch. Furthermore, the wristwatch 1 is preferably of the reversible type, i.e., it may indifferently show either of its faces to the wearer.

Figure 1:
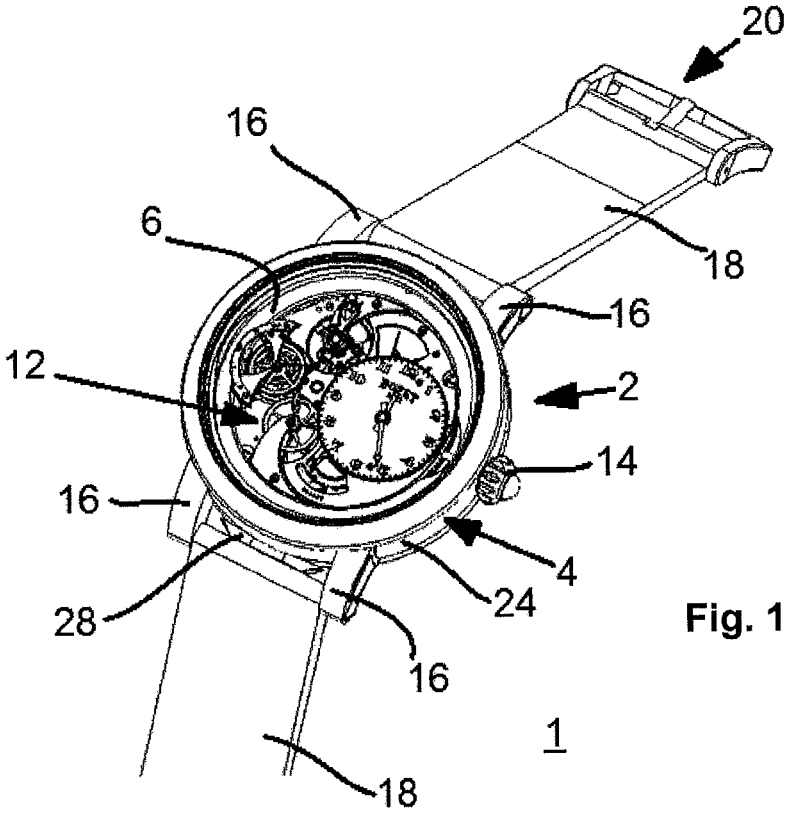
FIGS. 1 to 11 illustrate different simplified general perspective views of a wristwatch according to one preferred embodiment of the present invention, in different configurations.
Figure 2:
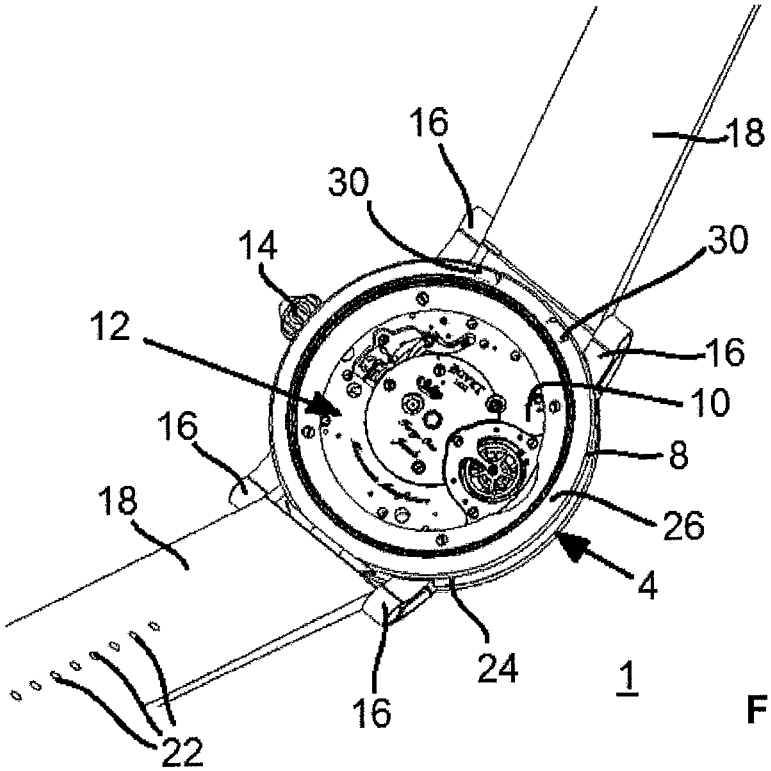

To that end, as in particular shown by FIGS. 1 and 2, the wristwatch 1 includes a case 2 comprising a middle 4 bearing a first glass 6, and a back 8 bearing a second glass 10.

In a known manner and with no impact on the implementation of the present invention, the middle 4 is arranged to house a clockwork movement 12 intended to allow the display of time information. A crown 14 is also provided, conventionally in particular to allow time setting. The crown 14 can be arranged in any location of the wristwatch without impact on the implementation of the present invention. For example, it may in particular be retractable in a suitable hole of the middle 4 without going beyond the scope of the invention.

The wristwatch 1 also includes two pairs of horns 16, each of which here bears a bar (not shown) for fastening a strand 18 of the bracelet. One strand bears a buckle-tongue assembly 20, while the other strand bears perforations 22 intended to cooperate with the tongue, in a known manner.

Of course, the one skilled in the art will not encounter any particular difficulty in adapting these elements based on his specific needs. At least one of the bracelet strands 18 may alternatively be secured to the middle 4 via a bow, for example. Similarly, the bracelet may alternatively include only one extendable strand, or two strands associated with a clasp of the folding type, without going beyond the scope of the invention. The use of a bracelet with links, for example made of metal, may also be considered without going beyond the scope of the invention.

Here, the case 2 is round, by way of non-limiting illustration, and the middle 4 therefore has an annular shape. More specifically, the middle 4 includes a cylindrical side wall 24, joining first and second faces here respectively associated with the glasses 6 and 10 in order to simplify the description.

For the needs of the description, a median plane of the middle 4 is defined located between its first and second faces while being substantially parallel to the latter and passing substantially through the center of the crown 14.

Advantageously but not necessarily for the implementation of the present invention, the elements of the clockwork movement 12 that are respectively visible by the first face and the second face are different, as emerges from a comparative examination of FIGS. 1 and 2.

It will be noted that a cover 26, here assuming the form of a bezel, is arranged on the second face of the middle 4, as shown in FIG. 2. The cover 26 is secured to the middle 4 via a hinge 28 arranged at six o'clock by way of non-limiting illustration. The hinge 28 defines a rotation axis of the cover 26 substantially parallel to the median plane of the middle 4.

The function of the cover 26 will be explained hereinafter, in connection with FIGS. 3 to 11.

Figure 3:
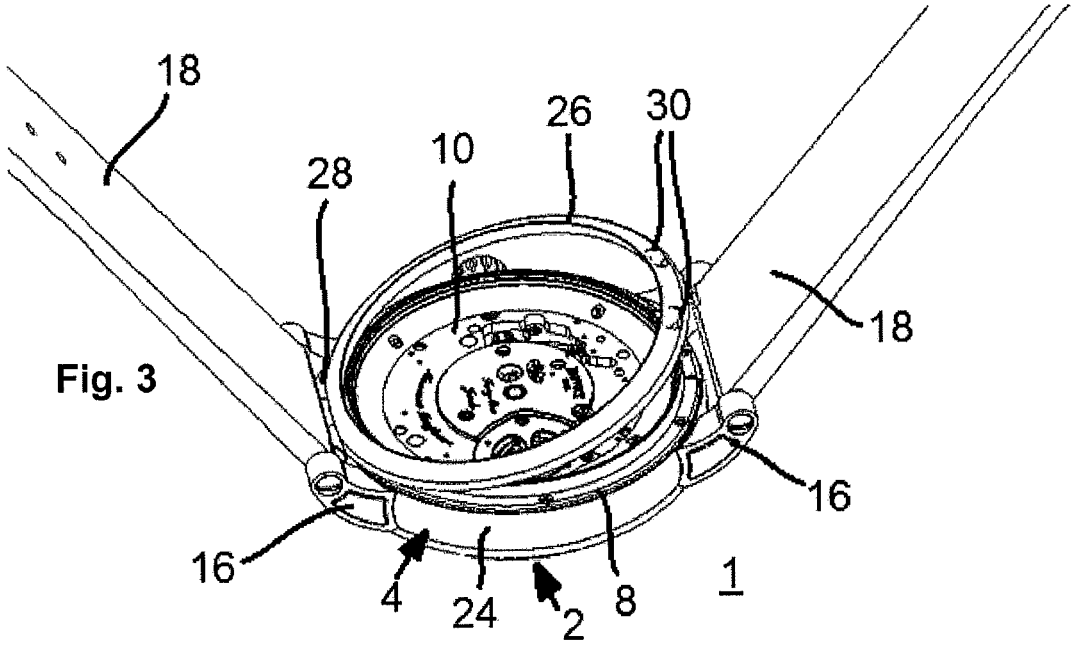
Figure 4:
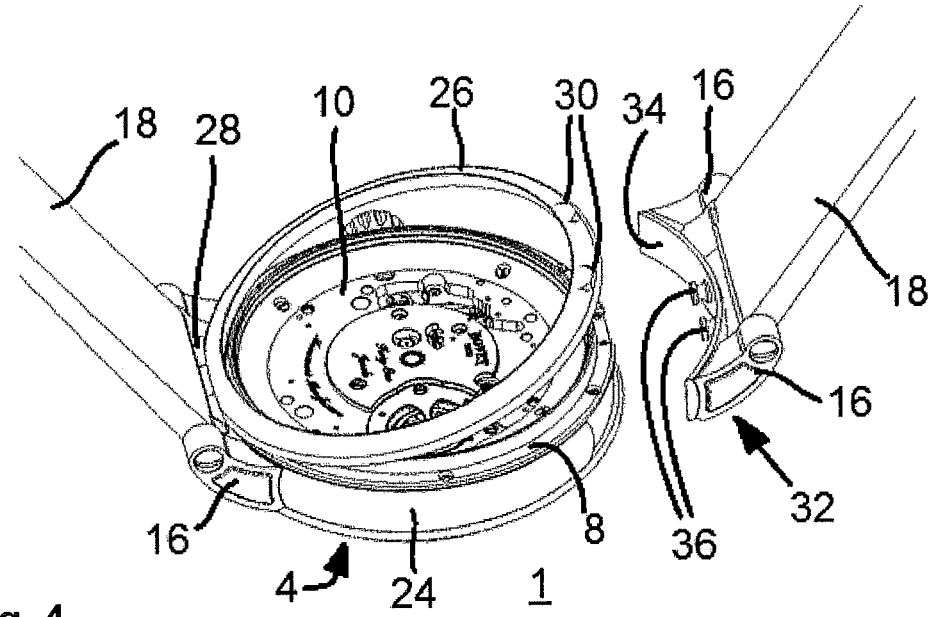

The cover 26 is provided with two bolts 30, next to one another and diametrically opposite the implantation of the hinge 28, such that a user can exert a pulling force on the bolts 30 to free the cover 26 from its closed position, as illustrated in FIG. 2, and pivot it in reference to the middle 4, as illustrated in FIGS. 3 and 4.

The cover 26 is arranged to cooperate with a locking mechanism of the bracelet.

More specifically, fastening organs are provided in the middle 4 as will be explained later.

When the cover 26 is freed from its closed position, it frees a first bracelet strand 18 located at twelve o'clock, i.e., the bracelet strand furthest from the implantation of the hinge 28.

This bracelet strand 18 can then be freed from the middle 4 as illustrated in FIG. 4.

FIG. 4 shows that each bracelet strand 18 bears an insert 32 defining one end of the bracelet. Each insert 32 includes a plate 34 bearing two studs 36 intended to serve as male fastening organs to provide the locking of the insert 32 on the middle 4, as will be explained later. The plate 34 here assumes a curved form, by way of non-limiting illustration, to marry the shape of the middle 4. Of course, the shape of the plate may be adapted to that of the middle 4 without going beyond the scope of the invention.

Furthermore, the horns 16 are also secured to the plate 34.

FIG. 4 also shows that the middle 4 advantageously includes optional recesses 38 (only one of which is visible in FIG. 4) suitable for at least partially housing the plates 34, when the bracelet is assembled to the case 2, such that the structure of the assembly is invisible for the wearer of the wristwatch 1.

Figure 5:
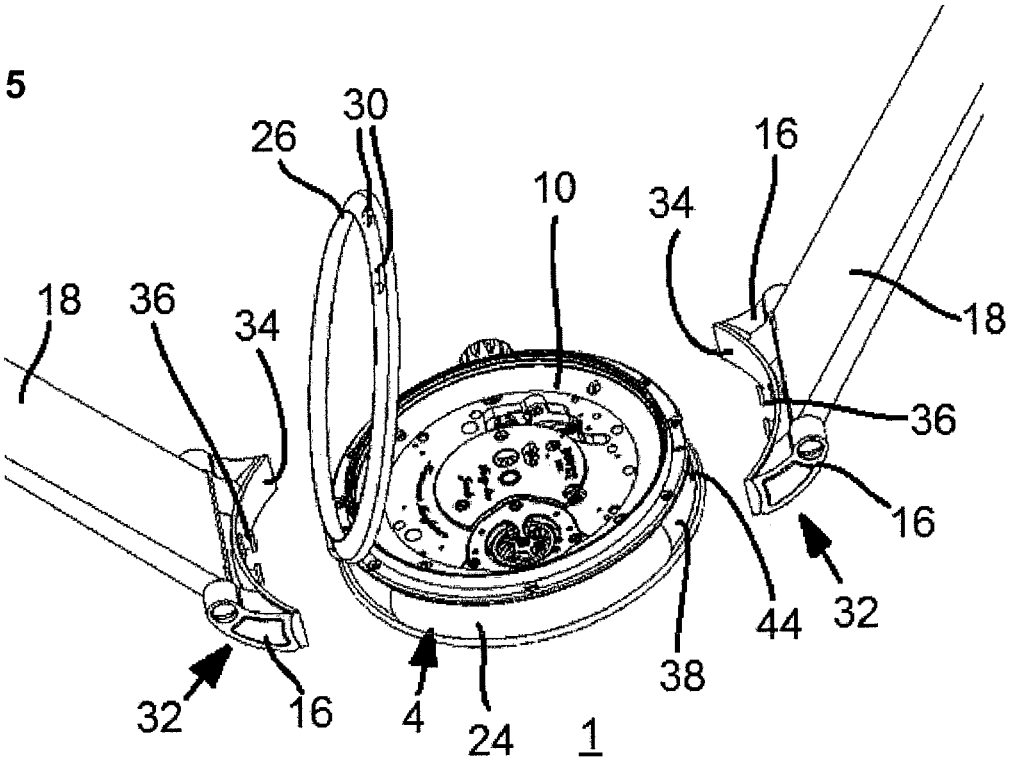

When the cover 26 is driven to pivot further, to an open position illustrated in FIG. 5, here substantially corresponding to a 90 degree angle, it releases the second bracelet strand 18, which can then also be freed from the middle 4.

Figure 6:
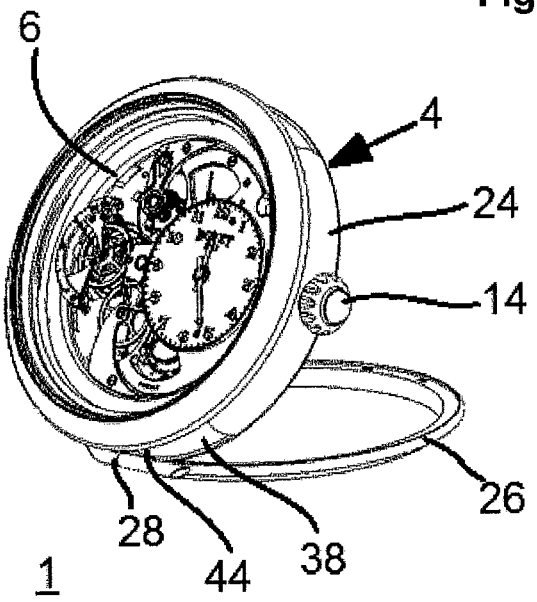

The cover 26 can advantageously next be returned to an intermediate position, as illustrated in FIG. 6, here with an angle of about 60 degrees in reference to the median plane of the middle 4.

The wristwatch 1 can then be used as a table watch, the cover 26 defining a support thereof.

It will be noted that the removal of the bracelet is advantageously done simultaneously with the removal of the horns 16, which means that the transformation of the wristwatch 1 from its configuration as a wristwatch to its configuration as a table watch is done without detriment to its appearance.

The case 2 according to the preferred embodiment of the present invention preferably comprises a locking device (not shown) for locking the cover 26 in a preferred intermediate position in reference to the middle 4. This locking device makes it possible to define an angle between the cover and the middle that is particularly suitable for using the wristwatch 1 as a table watch.

This locking device may include at least one male locking organ and at least one female locking organ, which are arranged to cooperate with one another in the preferred angular position, one being secured to the middle and the other being secured to the cover.

More specifically, the locking organ, which is secured to the cover, may bear two ball clicks facing each other and making up male locking organs. Furthermore, the middle may bear a positioning element having two holes intended to cooperate with the ball clicks to make up female organs of the additional locking device.

Of course, it is possible to provide a small amount of friction between the two parts of the hinge 28, alternatively or additionally, to provide the stability of any open position of the cover 26 relative to the middle 4. However, the implementation of a locking device as described above, while limiting the friction as much as possible between the two parts of the hinge, makes it possible to increase the perceived quality level of the corresponding timepiece.

Figure 7:
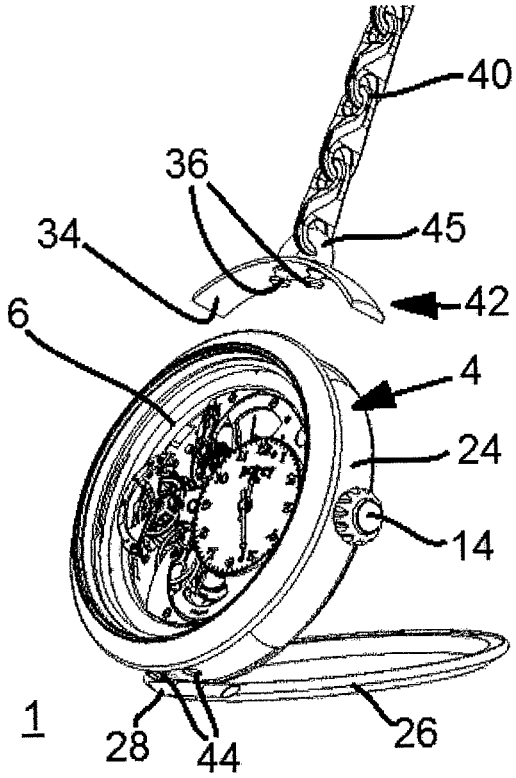
Figure 8:
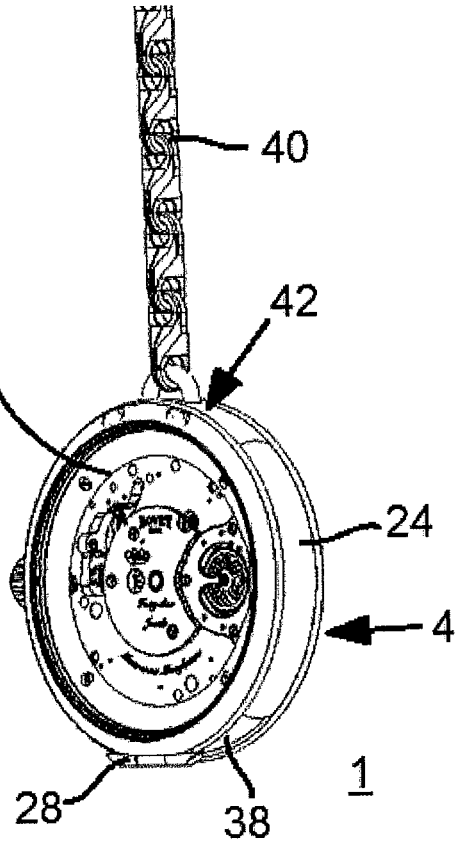

Starting from the configuration illustrated in FIG. 6, it is possible to provide the assembly of a chain 40 to the middle 4, as illustrated in FIGS. 7 and 8, to allow the use of the wristwatch 1 as a pocket watch.

In this case, the chain 40 is advantageously provided with an insert 42 defining its end intended to cooperate with the middle 4.

The insert 42 includes a plate 34 bearing two studs 36, similar to those of the inserts 32, the plate 34 here also bearing a ring 45 for fastening to the chain 40.

Once the insert 42 is placed against the middle 4, the cover 26 can be brought into its closed position to provide locking of the insert 42 and therefore the assembly of the chain 40 to the middle 4, to allow the use of the wristwatch 1 as a pocket watch, as illustrated in FIG. 8.

Figure 9:
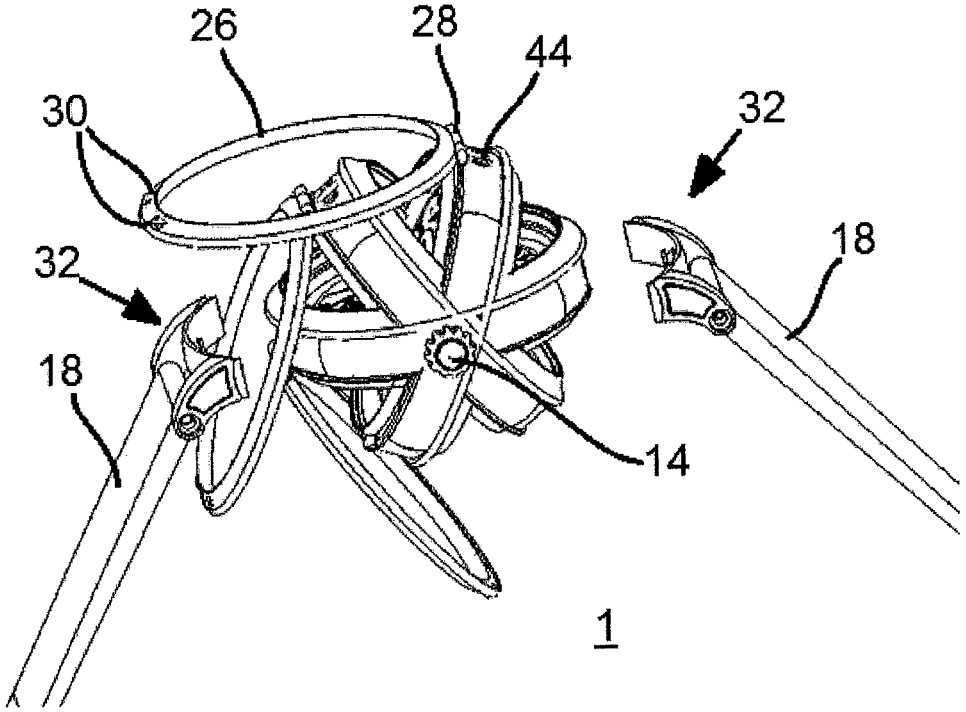
Figure 10:
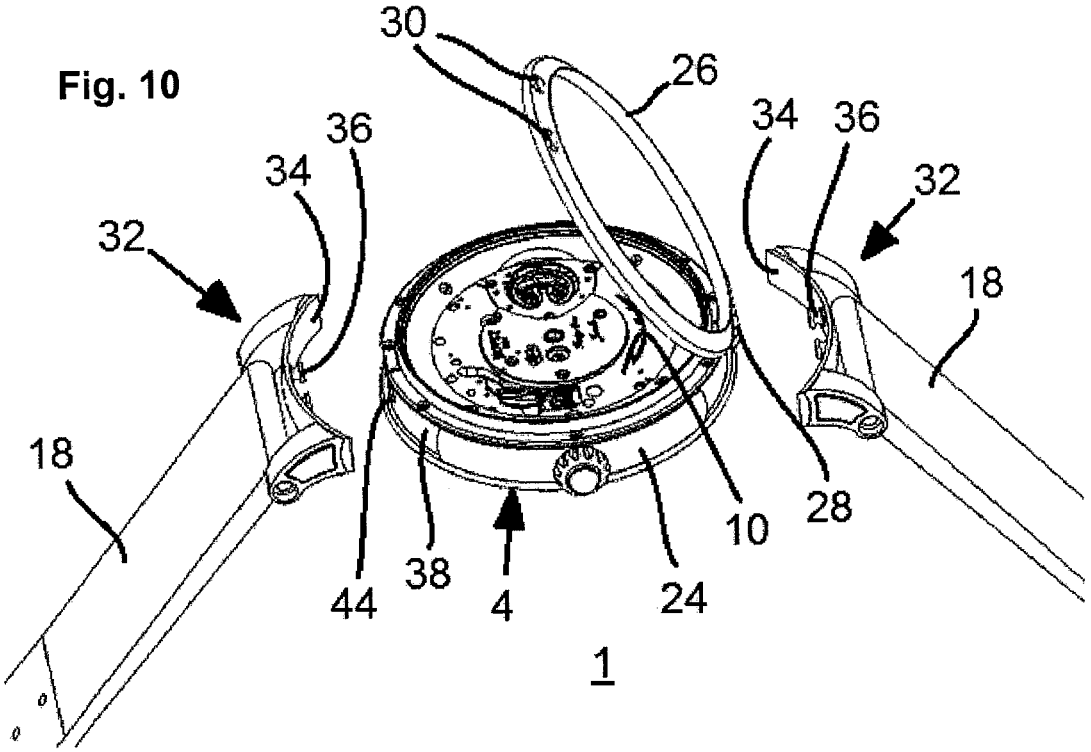

Starting from the configuration illustrated in FIG. 5, the case 2 can be pivoted by 180°, as shown schematically in FIG. 9 to show the wearer the second face of the middle, as illustrated in FIG. 10.

In this configuration, the cover 26 is then positioned to be visible to the wearer.

The bracelet strand 18 shown on the right in FIG. 10 can be inserted into the middle 4 first, before the cover 26 is pivoted toward the middle 4 to provide locking of this first bracelet strand 18.

The second bracelet strand 18 can then be inserted into the middle 4 before the cover 26 is placed in its closed position to provide the locking thereof, secondly.

Figure 11:
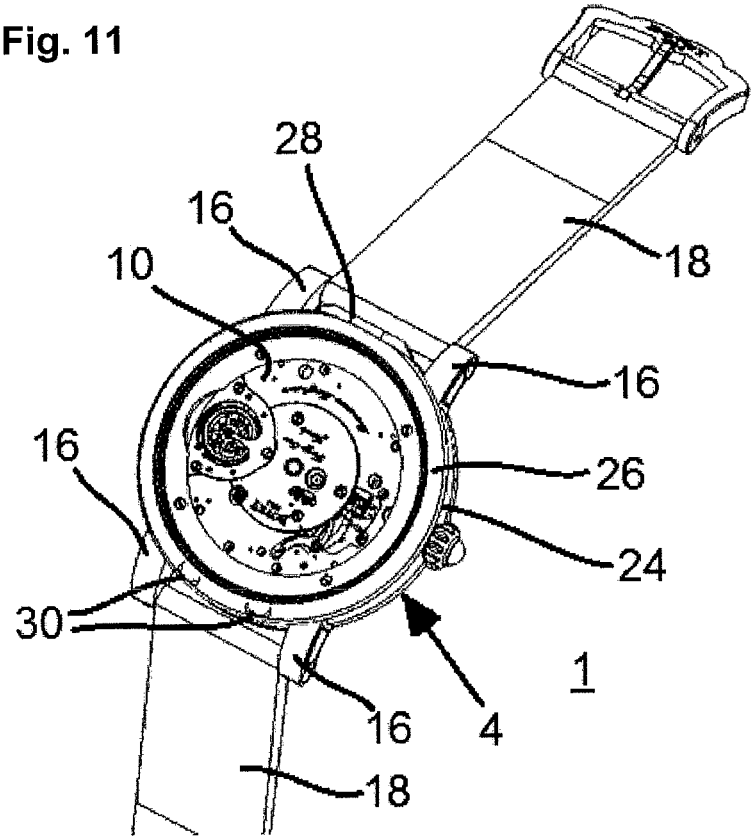

One then obtains the configuration illustrated in FIG. 11, in which one can see that the second face of the middle 4 is indeed positioned to be visible to the wearer of the wristwatch 1. The hinge 28, with a very discrete appearance, is visible on the second face of the middle 4, but while being positioned this time at twelve o'clock, the bolts 30 being present at six o'clock.

It emerges that the case 2 can be turned over very easily, in reference to the bracelet, to show one or the other of the two faces of the middle 4 to the wearer in the usage position, making the wristwatch 1 a reversible watch that is extremely easy to manipulate.

Of course, while the manipulation shown schematically in FIG. 9 corresponds to a rotation of the middle 4 around a rotation axis passing through the three o'clock and nine o'clock positions, it is also possible to perform a pivoting along a rotation axis passing through the six o'clock and twelve o'clock positions without going beyond the scope of the present invention, the crown 14 then going from the three o'clock position to the nine o'clock position.

Figure 12:
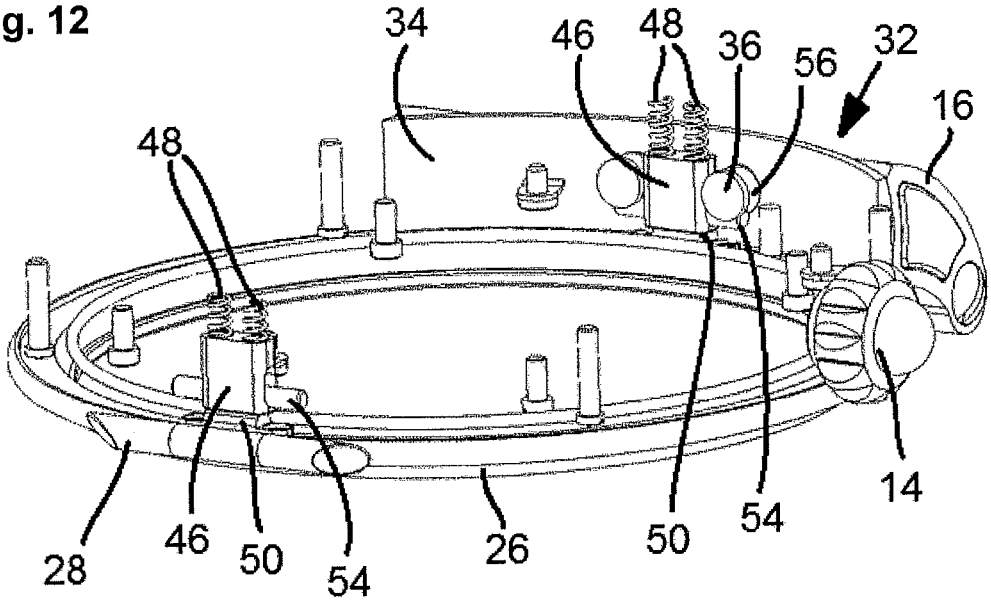
FIG. 12 shows a simplified perspective view of a construction detail of the timepiece of FIGS. 1 to 11, in a first configuration.

FIGS. 12 to 14 show simplified perspective views of a construction detail of the wristwatch 1, in first, second and third respective configurations.

More specifically, part of the middle 4 has been omitted in FIGS. 12 to 14 in order to show the locking mechanisms of the bracelet, in particular the fastening organs of the bracelet housed in the middle 4.

Each of the fastening organs of the middle 4 includes two holes 44, arranged in the middle 4 at six o'clock and twelve o'clock (partially visible in FIGS. 5, 7, 9 and 10), emerging on the one hand in the side wall 24 of the middle 4, and on the other hand across from locking pieces housed in the middle 4.

Each of the holes 44 is intended to cooperate with one of the studs 36, by insertion of the latter into the corresponding hole 44 in a direction substantially parallel to the median plane of the middle 4, such that the stud 36 next cooperates with the corresponding locking piece.

Each locking piece includes a sliding block 46 arranged in the middle 4 such that it is able to slide in a direction perpendicular to the median plane of the middle 4, on the one hand, under the effect of the action of a resilient organ 48, implemented by way of non-limiting illustration in the form of a pair of helical springs, and on the other hand, under the effect of the antagonistic action of an actuating organ 50 supported by the cover 26 and here assuming the form of a pad.

In the configuration illustrated in FIG. 12, the cover 26 is closed and both of its actuating organs 50 act on the sliding blocks 46 in order to oppose the action of the resilient organs 48 and push back the sliding blocks 46 away from the cover 26.

When the cover 26 is freed from its closed position, as illustrated in FIG. 13, one of the actuating organs 50 (that which is diametrically opposite the hinge 28) releases the corresponding sliding block 46 and allows it to slide toward the cover 26 under the effect of the action of its resilient organ 48.

When the cover 26 pivots further to its open position, as illustrated in FIG. 14, its other actuating organ 50 releases the corresponding sliding block 46, which can also slide toward the cover 26 under the action of its resilient organ 48.

It also emerges from FIGS. 12 to 14 that each sliding block 46 is provided with a through hole 52 in which a pin 54 is engaged which, as a result, moves in the same direction as the sliding block 46 in which it is engaged.

The ends of each of the pins 54 are located on either side of the corresponding sliding block 46 in order to cooperate with an appropriate hollow 56 arranged in each of the studs 36.

It will be noted that when a locking piece (or the corresponding sliding block) is in its locking position (FIG. 12), the corresponding pin 54 is engaged in the hollows 56 of the studs with which it is associated and thus provides the locking of the corresponding bracelet strand 18 (or the chain, if applicable).

Conversely, it will be noted that when a locking piece (or the corresponding sliding block) is in its neutral position (FIG. 14), the corresponding pin 54 is freed from the hollows 56 of the studs with which it is associated, thus leading to the release of the corresponding bracelet strand 18 (or the chain, if applicable).

Owing to this construction, a locking mechanism of the bracelet is obtained that is simultaneously easy to actuate, reliable, robust and compact.

The preceding description endeavors to describe a particular embodiment as a non-limiting illustration, and the invention is not limited to the embodiment of certain particular features that have been described above, for example the forms specifically illustrated and described for the case 2, the locking devices of the cover, or the inserts 32 and 42.

Indeed, the one skilled in the art will not encounter any particular difficulty in adapting the content of the present disclosure to his own needs and implementing a wristwatch whose construction reproduces the features of the invention without necessarily implementing, for example, two studs 36 to ensure the retaining of the bracelet in the case or two bolts to release the cover 26 from its closed position. Of course, although such a solution is not as secure as that which has been described, it is possible to use a single bolt or any other equivalent device making it possible to act on the cover 26 to release it from its closed position, without going beyond the scope of the present invention.

It is also possible to use only one stud, which in this case will have a shape not having a symmetry of revolution to avoid any rotation of the bracelet strand in reference to the middle 4. The locking piece structure would then be adapted accordingly.

It will be noted that although the holes 44 of the middle 4 are advantageously located substantially in the median plane of the middle 4 for symmetry reasons when the case is turned over, such a feature is not absolutely required to carry out the present invention.

Furthermore, it will also be noted that the case 2 preferably comprises a locking organ (not shown) arranged to guarantee the stability of the closed position of the cover 26 against the middle 4.

It will be recalled that advantageously, the passage from any configuration of the timepiece according to the present invention to another configuration can be done very simply and without requiring the use of any tools.

The invention claimed is:

1. A wristwatch comprising:

a middle having a side wall, joining first and second faces of said middle and defining a median plane between them, and comprising first and second fastening organs of a bracelet that are diametrically opposite, to secure respective first and second ends of a bracelet to said middle, a cover arranged to be able to at least partially cover one of said first and second faces while being able to pivot in reference to said middle between a first, closed position, in which said ends of the bracelet are locked on said middle, and a second, open position, in which said ends of the bracelet are free to be separated from said middle, said cover being arranged to be able to pivot along a rotation axis substantially parallel to said median plane, and wherein each of said first and second fastening organs comprises a hole arranged in said side wall of said middle and intended to receive the corresponding end of the bracelet by insertion in a direction substantially parallel to said median plane.

2. The wristwatch according to claim 1, further comprising first and second inserts secured to the bracelet, to define said first and second ends thereof, and each of which bears a male fastening organ intended to be inserted in said corresponding hole of said middle to secure said first and second ends of the bracelet to said middle.

3. The wristwatch according to claim 2, wherein each of said first and second fastening organs of said middle comprises a locking piece movable between a locking position, associated with said closed position of said cover and in which it acts on the corresponding end of the bracelet to lock it, and a neutral position, associated with said open position of said cover and in which it frees the corresponding end of the bracelet, said cover having first and second actuating organs arranged to cooperate with said locking pieces and position them in their locking position in said closed position of said cover.

4. The wristwatch according to claim 3, wherein each of said first and second fastening organs also comprises an elastic organ arranged to act on said corresponding locking piece and tending to position it in its neutral position.

5. The wristwatch according to claim 4, wherein each of said locking pieces comprises a sliding block arranged:

to cooperate with the corresponding actuating organ of said cover and with said elastic organ, and to act on a pin arranged so as to be able to move and lock the corresponding end of the bracelet in said closed position of said cover.

6. The wristwatch according to claim 5, wherein each of said male fastening organs has a recess arranged to cooperate with said corresponding pin in said closed position of said cover.

7. The wristwatch according to claim 2, wherein each of said inserts comprises two horns to provide its mechanical connection to the bracelet.

8. The wristwatch according to claim 2, wherein at least one of said inserts comprises a bow to provide its mechanical connection to the bracelet.

9. The wristwatch according to claim 3, wherein said cover is mechanically connected to said middle via a hinge and wherein one of said actuating organs is adjacent to said hinge.

10. The wristwatch according to claim 2, wherein each of said fastening organs of said middle comprises an additional hole arranged in said side wall of said middle, and wherein each of said male fastening organs comprises two studs intended to be inserted in the corresponding holes of said middle to provide the connection of the bracelet to said middle.

11. The wristwatch according to claim 10, wherein each of said inserts comprises a plate bearing said studs, and in that said side wall of said middle has two recesses arranged around said holes and each of which is suitable for at least partially housing one of said plates when the bracelet is assembled to said middle.

12. The wristwatch according to claim 1, further comprising a locking device of said cover arranged to lock it in at least one preferred open angular position, in reference to said middle, such that said cover can define a support for using the wristwatch as a table watch when the bracelet is freed from said middle.

13. The wristwatch according to claim 1, further comprising a locking organ arranged to guarantee the stability of the closed position of said cover against said middle.

14. The wristwatch according to claim 1, wherein said cover is in the form of a bezel.

15. The wristwatch according to claim 1, wherein said holes of said middle are arranged substantially in said median plane to allow an indifferent use of said first face or said second face in the usage position.

16. An assembly comprising a wristwatch according to claim 1 and a chain provided with an insert comprising a male fastening organ able to be inserted into one of said holes of said middle to secure said chain to said middle and to allow the use of the wristwatch as a pocket watch when the bracelet is freed from said middle.

17. The wristwatch according to claim 5, wherein each of said fastening organs of said middle comprises an additional hole arranged in said side wall of said middle, and wherein each of said male fastening organs comprises two studs intended to be inserted in the corresponding holes of said middle to provide the connection of the bracelet to said middle.

18. The wristwatch according to claim 10, further comprising a locking device of said cover arranged to lock it in at least one preferred open angular position, in reference to said middle, such that said cover can define a support for using the wristwatch as a table watch when the bracelet is freed from said middle.

19. The wristwatch according to claim 10, wherein said cover is in the form of a bezel.

20. The wristwatch according to claim 17, wherein said cover is in the form of a bezel.

* * * * *